US010525368B1

(12) United States Patent
Ward et al.

(10) Patent No.: US 10,525,368 B1
(45) Date of Patent: Jan. 7, 2020

(54) CHARACTER FIGURE AND METHOD FOR ATTACHING HAIR TO CHARACTER FIGURE

(71) Applicant: SPIN MASTER LTD., Toronto (CA)

(72) Inventors: Mercedeh M. Ward, Torrance, CA (US); Oliver L. Pope, Hermosa Beach, CA (US)

(73) Assignee: SPIN MASTER LTD., Toronto, Ontario (CA)

( * ) Notice: Subject to any disclaimer, the term of this patent is extended or adjusted under 35 U.S.C. 154(b) by 0 days.

(21) Appl. No.: 16/277,665

(22) Filed: Feb. 15, 2019

Related U.S. Application Data

(60) Provisional application No. 62/788,994, filed on Jan. 7, 2019.

(51) Int. Cl.
*A63H 3/44* (2006.01)

(52) U.S. Cl.
CPC ..... *A63H 3/44* (2013.01)

(58) Field of Classification Search
CPC ..... A63H 3/00; A63H 3/36; A63H 3/44
See application file for complete search history.

(56) References Cited

U.S. PATENT DOCUMENTS 1,627,511 A * 5/1927 Hopf ..... A63H 3/44 446/394
2,152,085 A * 3/1939 Palmer ..... A63H 3/44 446/394
3,032,923 A * 5/1962 Von Sternberg ..... A63H 3/44 446/319
3,313,060 A * 4/1967 Mobley, Jr. ..... A63H 3/36 446/391
3,448,540 A * 6/1969 Mucciante ..... A63H 3/48 446/337
3,500,578 A * 3/1970 Albert ..... A63H 3/44 446/394
RE27,267 E * 1/1972 Lilenstern ..... A63H 3/44 446/319
3,698,134 A * 10/1972 Amici ..... A63H 3/44 446/319
4,170,085 A * 10/1979 Luke ..... A63H 3/44 446/319
4,450,129 A * 5/1984 Dunn ..... A63H 3/44 264/132
5,180,325 A 1/1993 Eddins et al.
(Continued)

*Primary Examiner* — Eugene L Kim
*Assistant Examiner* — Alyssa M Hylinski
(74) *Attorney, Agent, or Firm* — Millman IP Inc.

(57) ABSTRACT

In an aspect, a character figure is provided, and includes a body, a hair holder and a clump of hair. The hair holder is mounted to the body and encloses an interior volume therewith. The hair holder at least in part defines hair pass-through apertures including at least first and second hair pass-through apertures. The clump of hair has a central region with a knot that is positioned in the interior volume. The clump of hair further includes a first and second end portions extending from the central region. The first end portion passes through the first hair pass-through aperture to an exterior of the character figure. The second end portion passes through the second hair pass-through aperture to the exterior of the character figure. The knot is unable to pass-through any of the hair pass-through apertures that hair from the clump of hair passes through.

14 Claims, 12 Drawing Sheets

(56) References Cited

U.S. PATENT DOCUMENTS

| | | | | | |
|---|---|---|---|---|---|
| 5,560,320 | A * | 10/1996 | Plunk | A01K 15/026 | 119/709 |
| 5,586,696 | A * | 12/1996 | Martinez | A45D 44/14 | 132/53 |
| 5,607,338 | A * | 3/1997 | Landi | A63H 3/44 | 132/201 |
| 6,217,407 | B1 * | 4/2001 | Laursen | A63H 3/44 | 446/394 |
| 8,393,300 | B2 * | 3/2013 | Markham | A01K 15/026 | 119/709 |
| 2007/0249261 | A1 * | 10/2007 | Norman | A63H 3/44 | 446/394 |

* cited by examiner

CHARACTER FIGURE AND METHOD FOR ATTACHING HAIR TO CHARACTER FIGURE

CROSS-REFERENCE TO RELATED APPLICATIONS

This application claims the benefit of U.S. Provisional Application No. 62/788,994, filed Jan. 7, 2019, the contents of which are incorporated herein by reference in their entirety.

FIELD

The specification relates generally to character figures, such as dolls, that have hair. In particular, the following relates to character figures with hair that is resistant to removal.

BACKGROUND OF THE DISCLOSURE

In the industry of doll-making, it is desirable to construct a doll to have hair for added realism. However, it is sometimes difficult to manufacture a doll with hair that is strongly connected to the head of the doll. If the hair is manipulated too roughly it can inadvertently be removed from the head. Sometimes costly manufacturing techniques may be used such as gluing or the like are used, thereby increasing the cost of manufacture of the doll. It would be advantageous to provide a character figure that has hair that is resistant to removal from the body of the character figure.

SUMMARY OF THE DISCLOSURE

In one aspect, there is provided a character figure, which includes a body, a hair holder and a clump of hair. The hair holder is mounted to the body and encloses an interior volume therewith. The hair holder at least in part defines a plurality of hair pass-through apertures including at least a first hair pass-through aperture and a second hair pass-though aperture. The clump of hair has a central region with a knot. The knot is positioned in the interior volume. The clump of hair further includes a first end portion extending from the central region and a second end portion extending from the central region. The first end portion passes through the first hair pass-through aperture to an exterior of the character figure. The second end portion may pass through the first hair pass-through aperture or the second hair pass-through aperture to the exterior of the character figure (or may remain in the interior volume). The knot is unable to pass-through any of the hair pass-through apertures that hair from the clump of hair passes through.

In another aspect, a method of attaching hair to a body of a character figure is provided. The character figure has a body, and a hair holder mountable to the body and enclosing an interior volume therewith. The hair holder at least in part defines a plurality of hair pass-through apertures including at least a first hair pass-through aperture and a second hair pass-though aperture. The method comprises:

a) providing the hair as a clump of hair having a central region with a knot therein, and having a first end portion extending from the central region and a second end portion extending from the central region, wherein the knot is unable to pass-through any of the hair pass-through apertures that hair from the clump of hair passes through; and b) mounting the hair holder to the body such that the knot is held in the interior volume and such that the first end portion of the clump of hair passes through the first hair pass-through aperture to an exterior of the character figure and such that the second end portion of the clump of hair passes through the second hair pass-through aperture to an exterior of the character figure.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
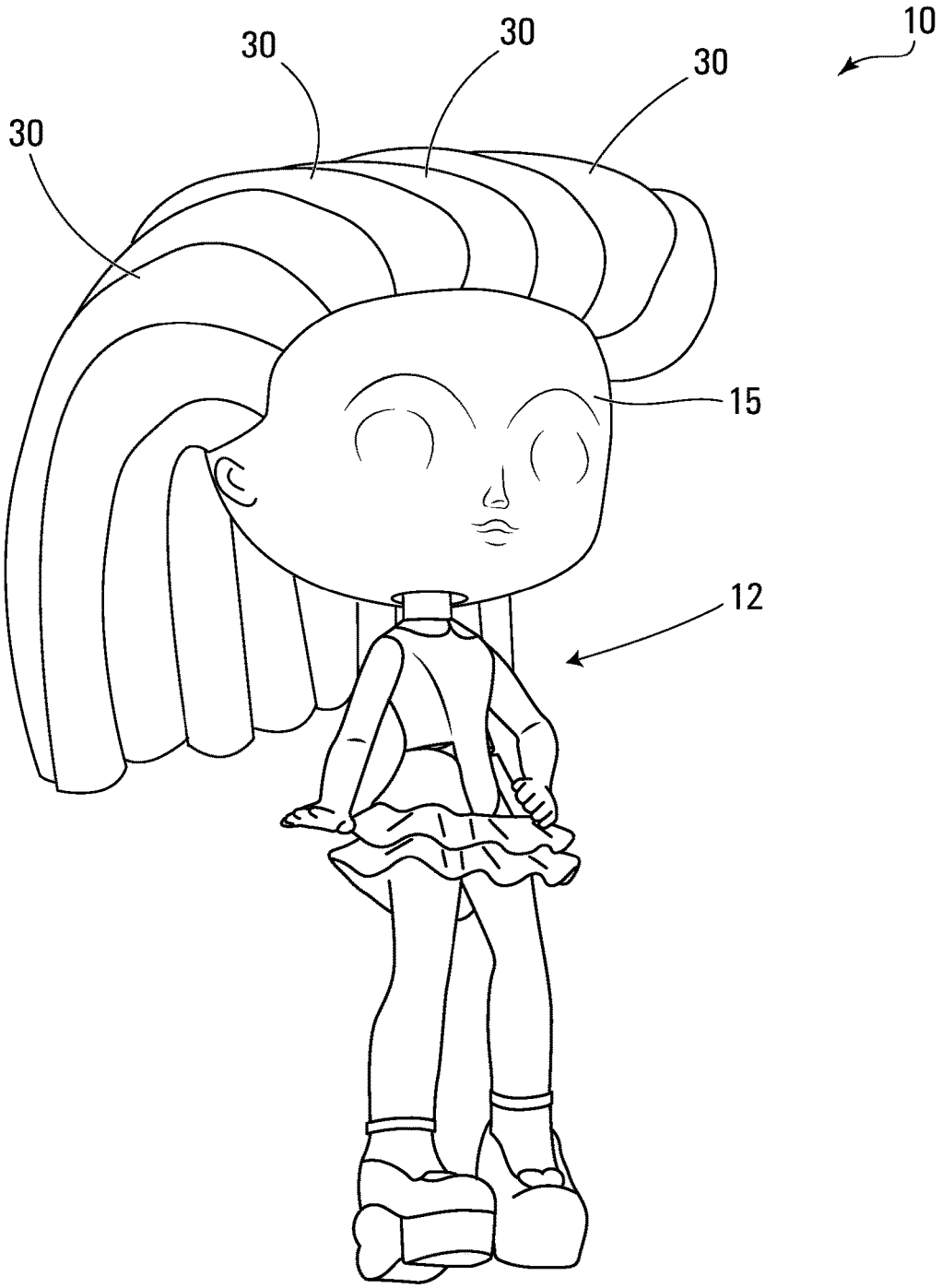
FIG. 1 is a perspective view of a character figure with hair in accordance with an embodiment of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 2:
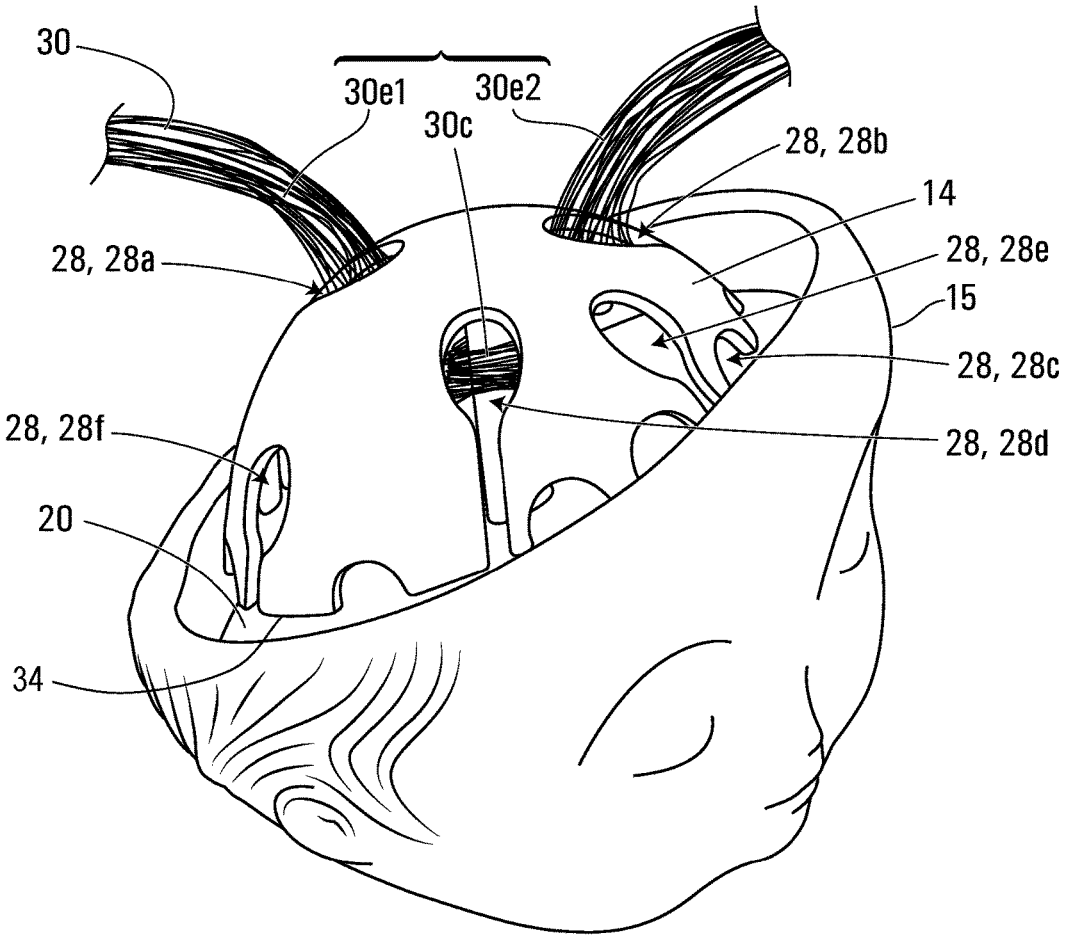
FIG. 2 is a magnified perspective view of a head from the character figure shown in FIG. 1.
Figure 3:
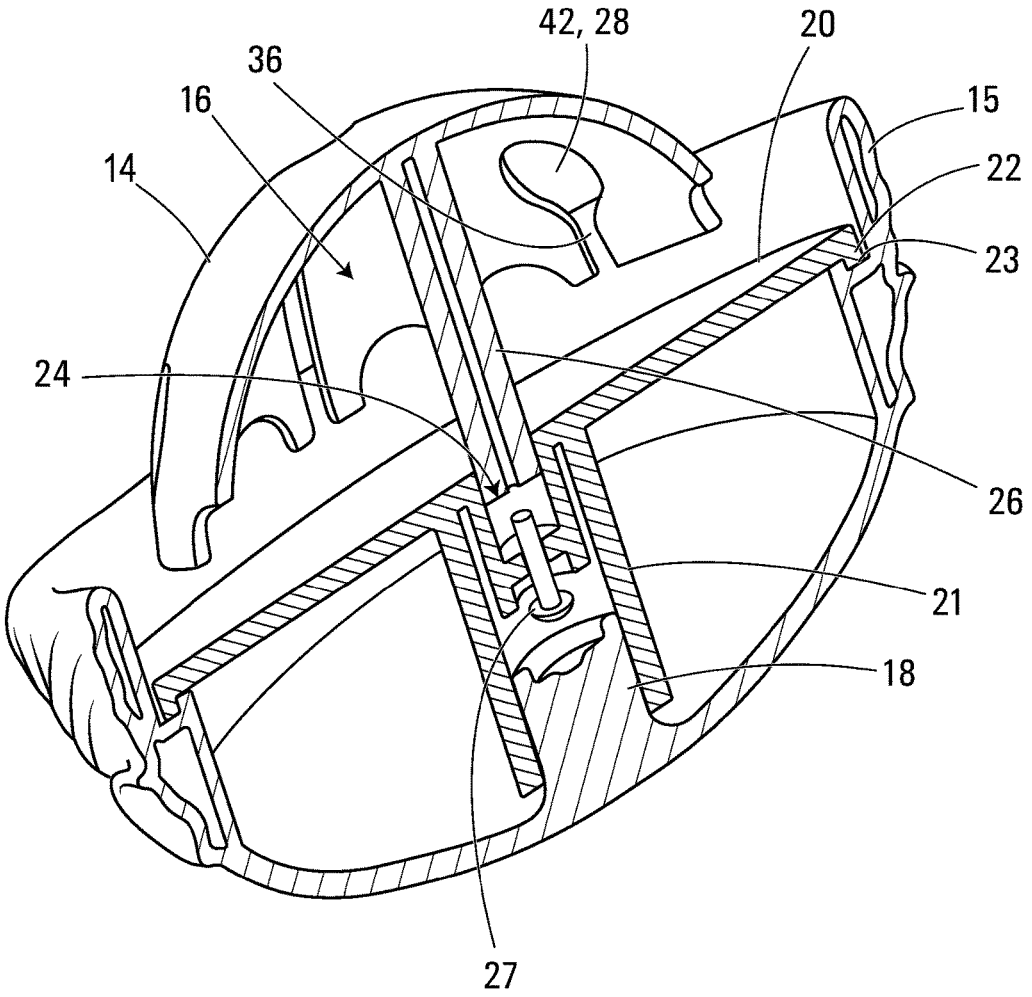
FIG. 3 is a sectional perspective view of the head shown in FIG. 2.
Figure 10:
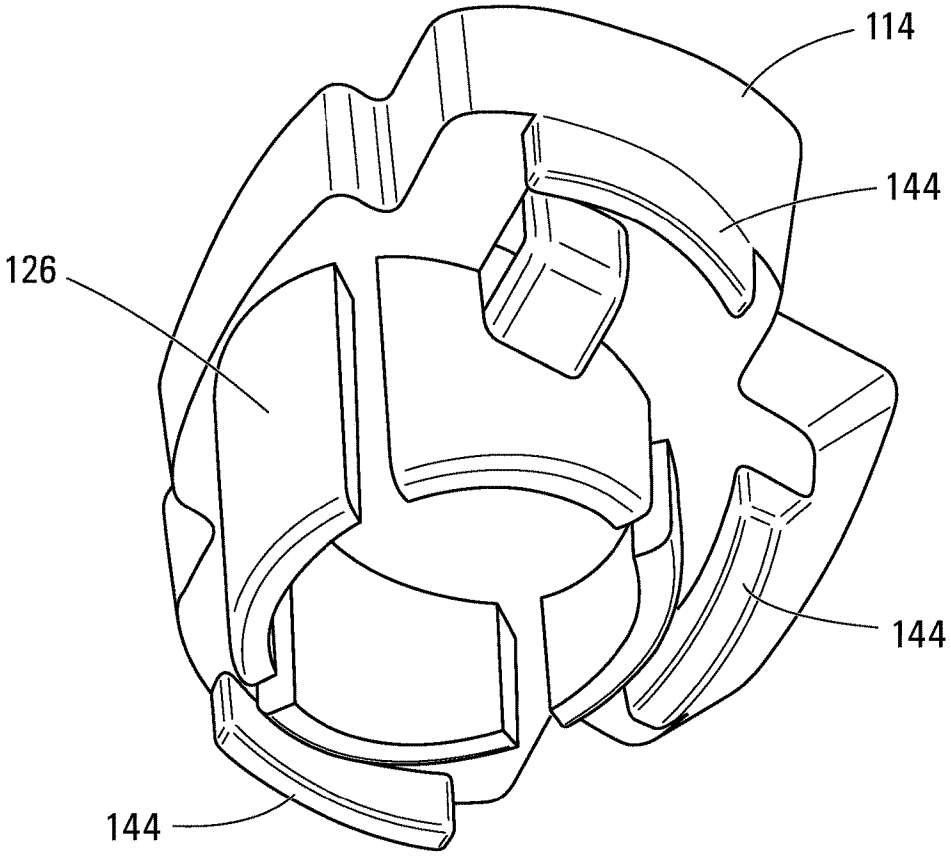
FIG. 10 is a perspective view of a hair holder from the character figure shown in FIG. 7.

Reference is made to FIG. 1, which shows a character FIG. 10. The character FIG. 10 includes a body 12. The body 12 may have any form, such as, for example, a generally humanoid form as shown in FIG. 1. Alternatively, the body 12 may have an animal form, a plant form, a vehicular form, or any other suitable object form. Referring to FIG. 2, in the present example, the body 12 includes a head 15. The head 15 has a body mounting post 18 therein. In the present example, the body 12 further includes a base 20 that includes a base mounting post 21 that has an aperture at its end which snugly receives the body mounting post 18, so as to mount the base 20 to the rest of the body 12. Adhesive may be used to secure the base mounting post 21 on the body mounting post 18. Additionally, the base 20 may include at its periphery a small peripheral projection 22 that is received in a projection-receiving groove 23 in the head 15. This braces the base 20 in the head 15. Optionally a suitable adhesive may be used to hold the peripheral projection 22 in the projection-receiving groove 23 to further strengthen the connection.

The base 20 itself includes a mounting aperture 24 therein.

A hair holder 14 is mounted to the body 12 and encloses an interior volume 16. In the example shown, the hair holder 14 mounts to the body 12 via a hair holder post 26 that is snugly received in the mounting aperture 24 of the base 20. A fastener 27 such as a screw is shown for joining the hair holder post 26 in the mounting aperture 24 of the base 20. The hair holder may be made from a suitably stiff material such as a suitable plastic.

The hair holder 14 at least in part defines a plurality of hair pass-through apertures 28 including at least a first hair pass-through aperture 28*a* and a second hair pass-though aperture 28*b*. In the example shown, there are several other hair pass-through apertures 28 including a third hair pass-through aperture 28*c*, a fourth hair pass-through aperture 28*d*, a fifth hair pass-through aperture 28*e*, a sixth hair pass-through aperture 28*f* and several others. Any suitable number of hair pass-through apertures 28 may be provided, such as one hair pass-through aperture 28 or any suitable number greater than that.

Referring to FIG. 2, a clump of hair 30 is shown. The hair itself may be formed from any suitable material such as an unwound yarn made from acrylic with a thread wound through it. In a preferred embodiment, the hair may be made from 50% acrylic/50% polyester with a thread wound through it to assist with tensile strength. Only a small number of representative strands of the hair are shown in FIG. 2. The clump of hair 30 has a central region 30*c* that has a knot 32 and at least a first end portion 30*e*1 extending from the central region and a second end portion 30*e*2 extending from the central region. The end portions 30*e*1 and 30*e*2 are shown cut off partially in FIGS. 2-5B so as to avoid visual clutter in the figures. The knot 32 (and the entirety of the central region 30*c*) is positioned in the interior volume 16. The first end portion 30*e*1 passes through the first hair pass-through aperture 28*a* to an exterior of the character FIG. 10. The second end portion 30*e*2 passes through the second hair pass-through aperture 28*b* to the exterior of the character FIG. 10. It is optionally possible in an embodiment for both the first and second end portions 30*e*1 and 30*e*2 to pass through the same hair pass-through aperture 28 in the hair holder 14. The knot 32 is unable to pass-through any hair pass-through apertures 28 that hair from the clump of hair 30 passes through. In the example shown in FIG. 2, since hair from the clump of hair 30 only passes through the first and second hair pass-through apertures 28*a* and 28*b*, the knot 32 need only be unable to pass through the first and second hair pass-through apertures 28*a* and 28*b*. In the example shown in FIG. 5A, the clump of hair 30 has a central region 30*c*, and first, second and third end portions 30*e*1, 30*e*2 and 30*e*3, which pass-through first, second and third hair pass-through apertures 28*a*, 28*b* and 28*c* respectively. In that example, the knot 32 is unable to pass through the first, second and third hair pass-through apertures 28*a*, 28*b* and 28*c*. In FIG. 5A, the clump of hair 30 is represented in transparent form so as not to obscure the other elements shown, and is represented only by its outer edges, as if it was a single, thick hair. It will be understood however that this is a representation only and that it is made up of many hundreds or more of individual strands.

In the examples shown in FIGS. 2 and 5A, the knot 32 is unable to pass through the hair pass-through apertures 28*a* and 28*b* (and 28*c* in FIG. 5A) because the central region 30*c* is tied to the hair holder post 26 via the knot 32, thereby preventing the knot 32 from passing through the relevant hair pass-through apertures 28 when the hair holder 14 is mounted to the body 12. In another example, shown in FIG. 5B, the knot 32 is unable to pass through any hair pass-through apertures 28 that hair from the clump of hair 30 passes through (in that case the hair pass-through apertures 28*a* and 28*b*) because the knot 32 is too large to pass through them.

Figure 4:
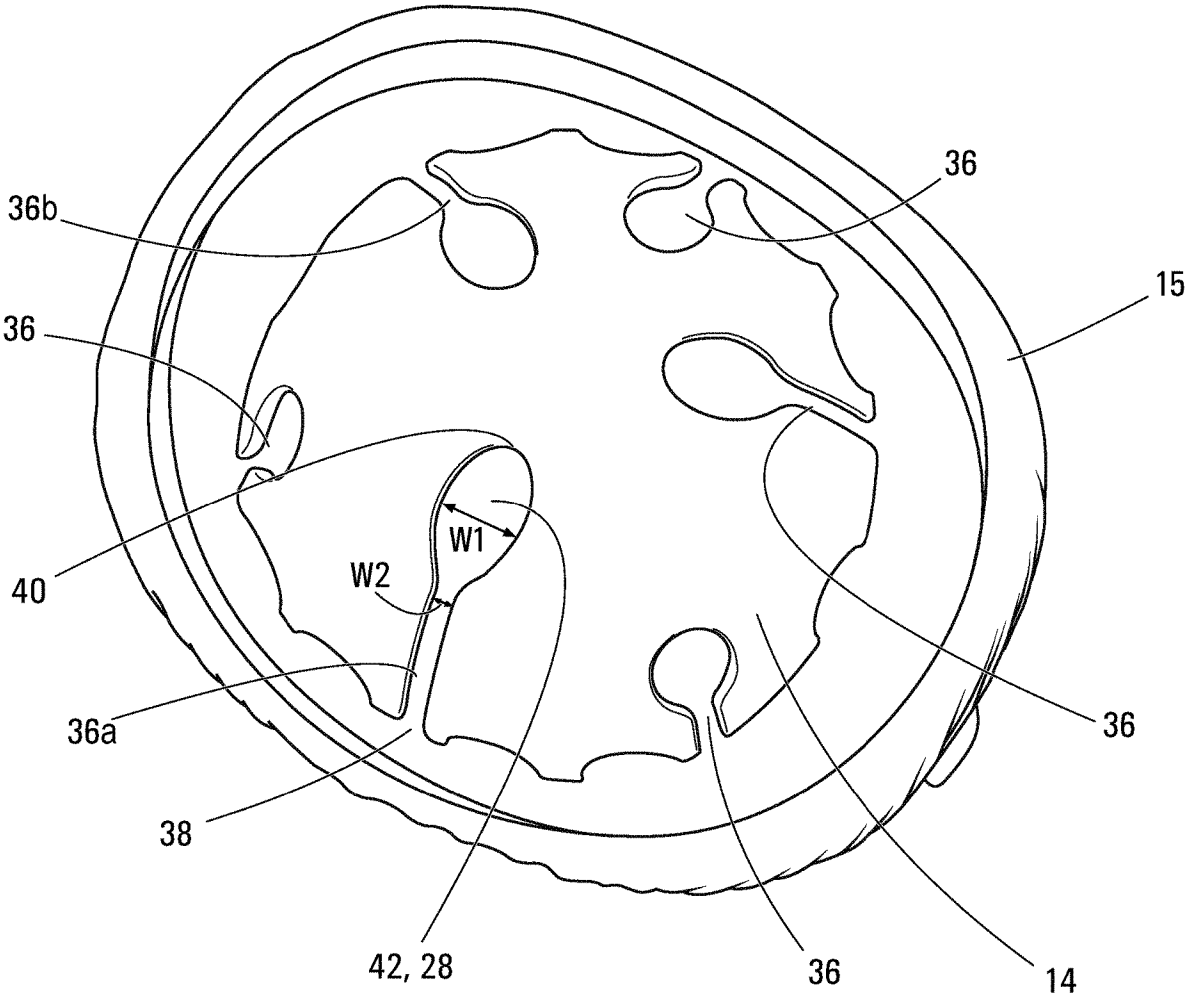
FIG. 4 is near-plan view of the head shown in FIG. 2.
Figure 5A:
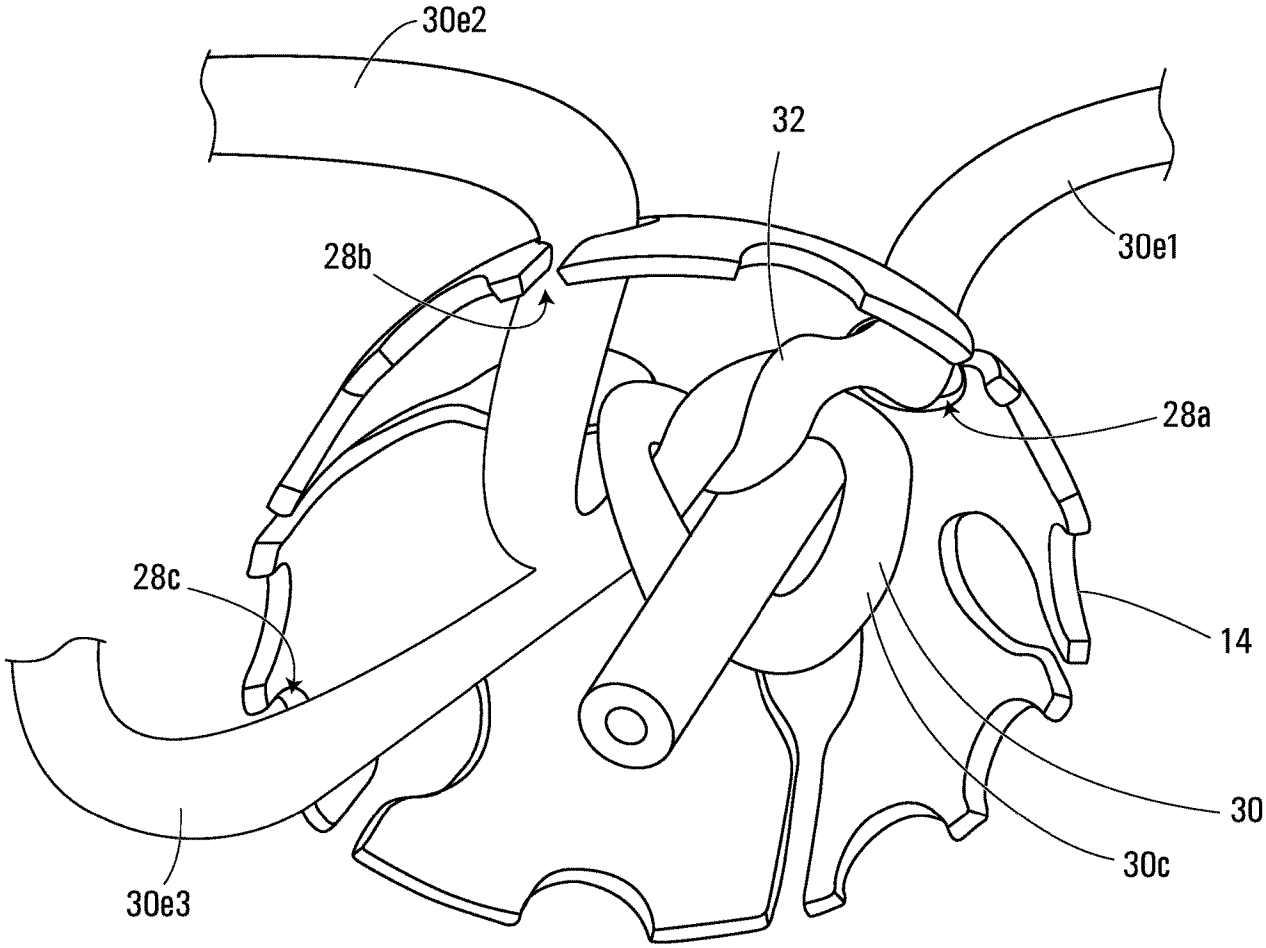
FIG. 5A is a perspective view of a hair folder from the head shown in FIG. 2.
Figure 5B:
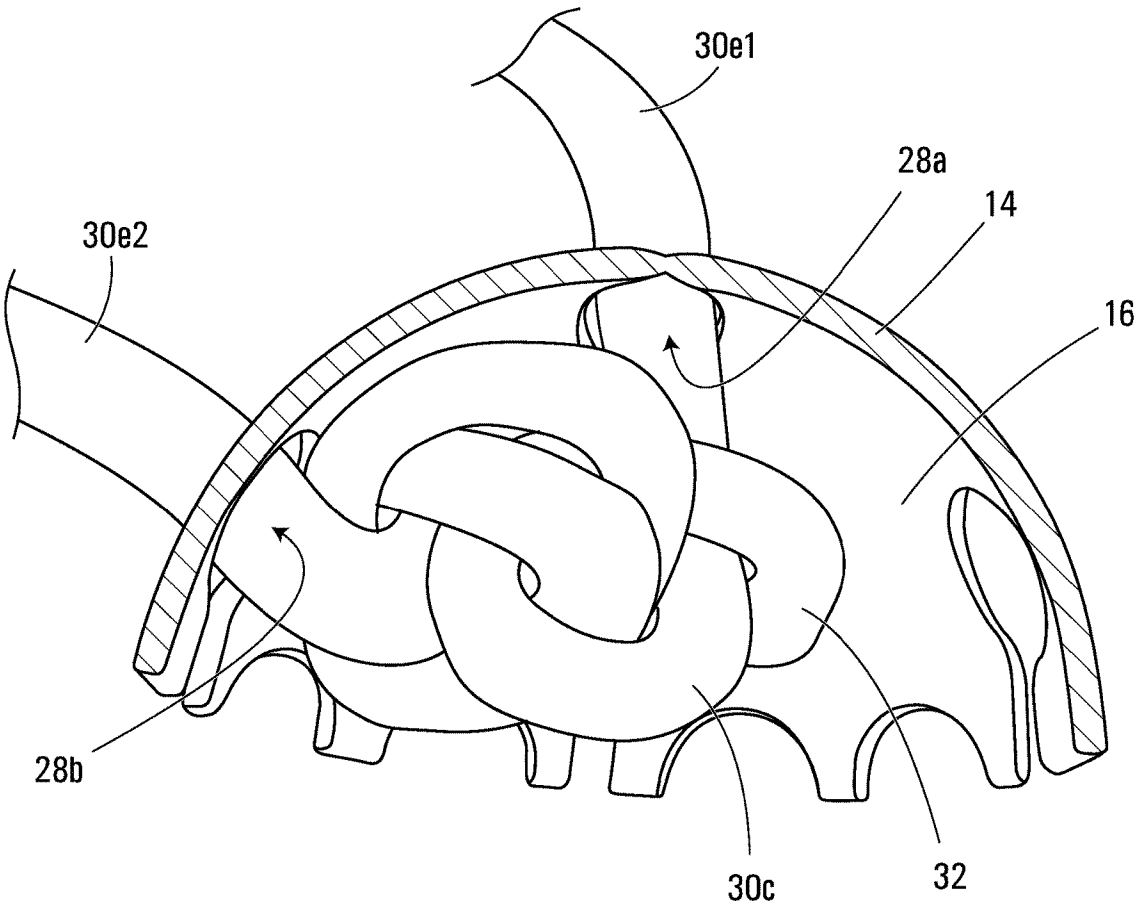
FIG. 5B is a sectional perspective view of the hair holder shown in FIG. 5A
Figure 6:
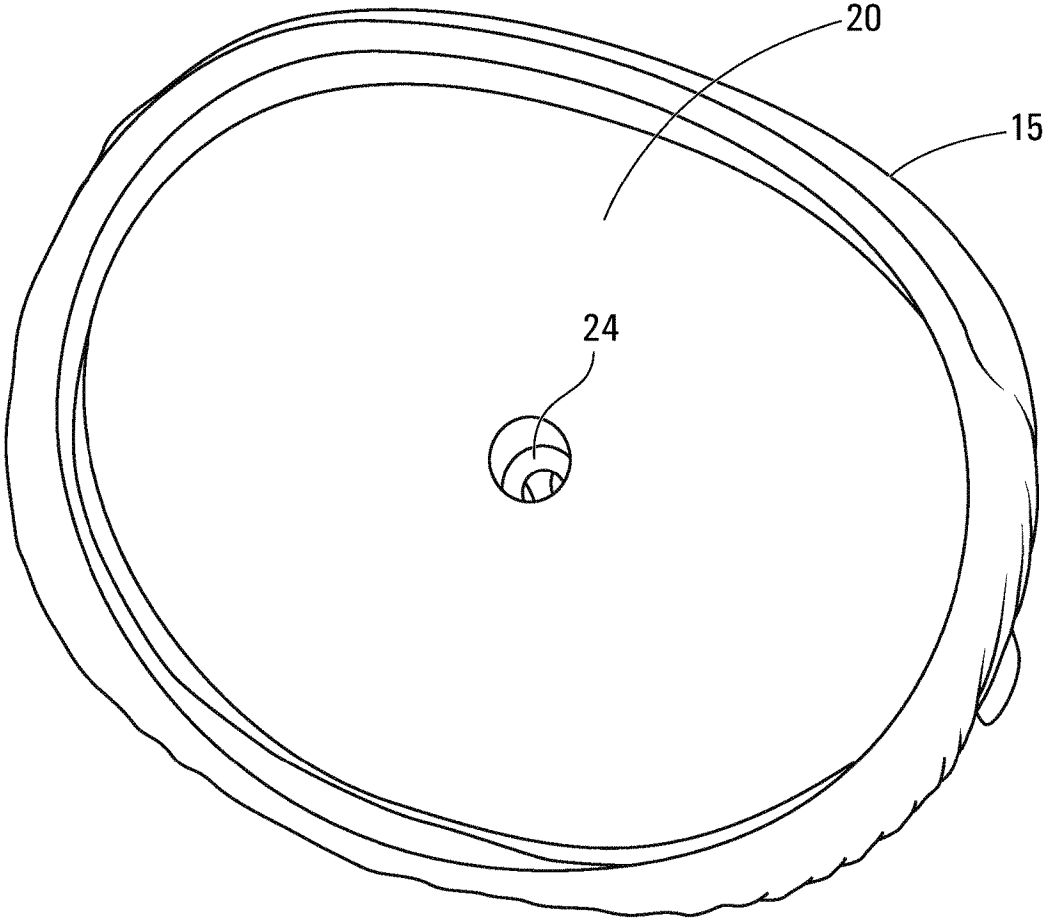
FIG. 6 is a near-plan view of the head shown in FIG. 2 without the hair holder

In the example shown in FIGS. 2-5B, the hair holder has a peripheral edge 34 and has a plurality of hair slots 36. As seen in FIG. 4, each of the plurality of hair slots 36 has a first, open, end 38 at the peripheral edge 34 and a second, closed, end 40. The hair slot 36 has an enlarged region 42 that has an enlarged region width W1 that is larger than a width W2 of a portion of the hair slot 36 immediately adjacent thereto towards the first, open, end 38. The enlarged region 42 of a first hair slot (shown at 36*a*) from the plurality of hair slots 36 is the first hair pass-through aperture 28*a*, and wherein the enlarged region 42 of a second hair slot 36*b* from the plurality of hair slots 36 is the second hair pass-through aperture 28*b*.

As shown best in FIG. 2, some of the hair pass-through apertures 28 are not enlarged regions of hair slots and are not solely defined by the hair holder 14. For example, the hair pass-through aperture 28*c* in FIGS. 2 and 5A is defined in part by the hair holder 14 and by the base 20.

In an alternative embodiment, a post could extend up from the base 20 and could be received in mounting aperture in the hair holder 14. In such an embodiment, it is possible for the central region 30*c* of the clump of hair 30 to be tied to the post extending up from the base 20.

While only a single example clump of hair 30 is shown in FIGS. 2-5B, a plurality of clumps of hair 30 may be provided for the character FIG. 10, with their central regions 30*c* having knots and contained in the interior volume 16 enclosed by the hair holder 14 and with their end portions 30*e*1, etc. passing through various hair pass-through apertures 28. All of the plurality of clumps of hair 30 may be knotted with one another to form one combined knot 32 in the interior volume 16.

It will be noted that the base 20 and the hair holder 14 cooperate to inhibit the movement of the central region 30*c* of the clump 30 of hair. The base 20 and the hair holder 14 may together compress the central region 30*c*. Alternatively or additionally, applying the knot 32 about the hair holder post 26 (or a post extending up from the body) can inhibit movement of the central region.

As a result of the arrangement disclosed, the character FIG. 10 has hair that can be pulled, combed and formed with substantially no risk of the hair being pulled out from the head 15 of the character FIG. 10.

Figure 7:
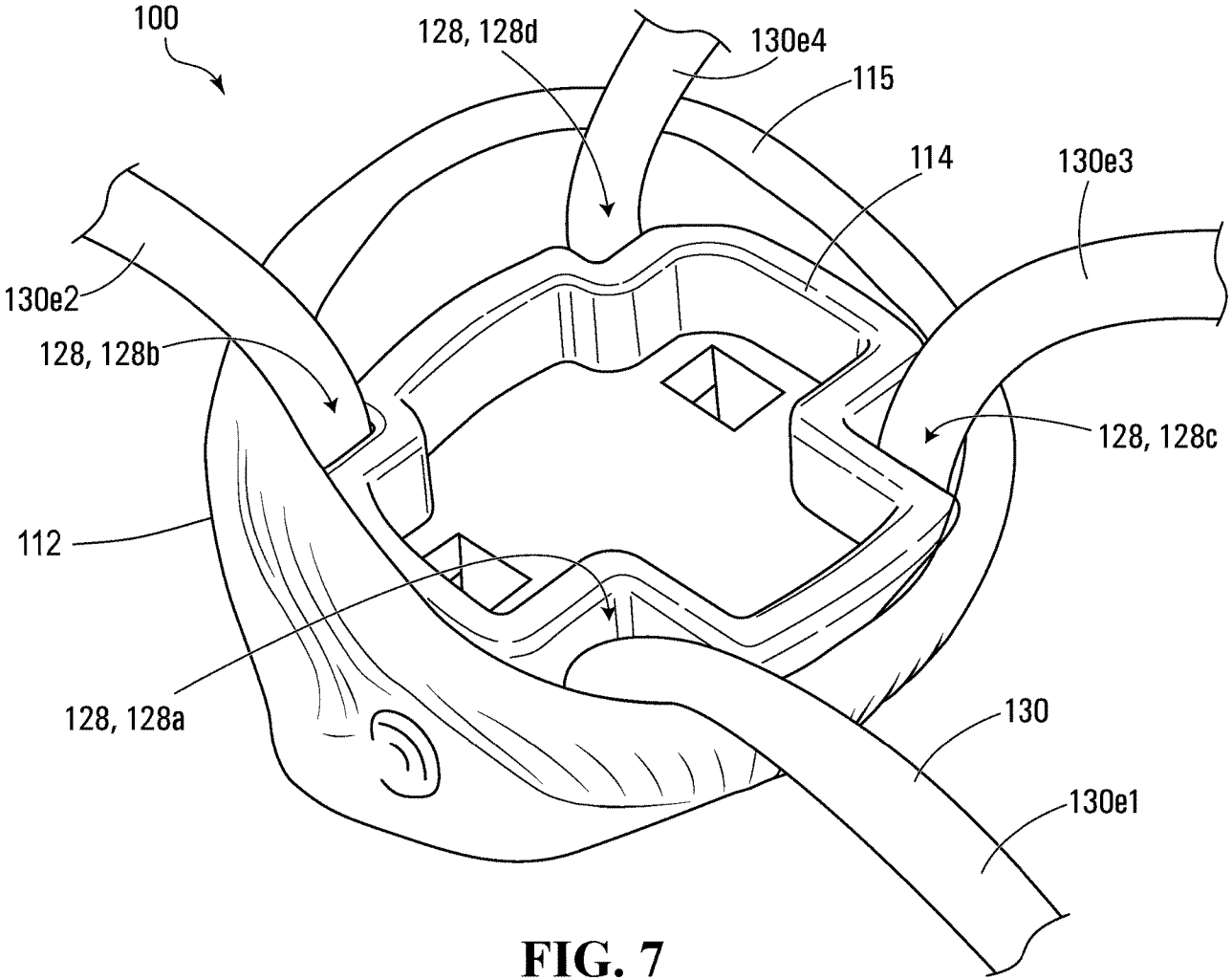
FIG. 7 is a perspective view of a head of a character figure with hair in accordance with another embodiment of the present disclosure

Reference is made to FIGS. 7-11, which show a portion of a character FIG. 100 in accordance with another embodiment of the present disclosure. Elements in the embodiment shown in FIGS. 7-11 are given reference numbers that are the same as their counterpart elements in FIGS. 1-6, but increased by 100. The portion of the character FIG. 100 shown in FIG. 7 is a head 115, which is a portion of a body shown at 112, of the character FIG. 100. The character FIG. 100 may be similar to the character FIG. 10 shown in FIGS. 1-6, but with some differences as described below. The character FIG. 100 includes the body 112 which may be similar to the body 12 (but which does not have a base that is removably mounted), and a hair holder 114. The hair holder 114 may be similar to the hair holder 14 and at least partially defines a plurality of hair pass-through apertures 128. In the present example, all of the hair pass-through apertures 128 are defined in part by the hair holder 114 and in part by the body 112. In the present example, four hair pass-through apertures 128 are shown, but any suitable number may be provided, such as one hair pass-through aperture 128 or any suitable number greater than that.

Figure 8:
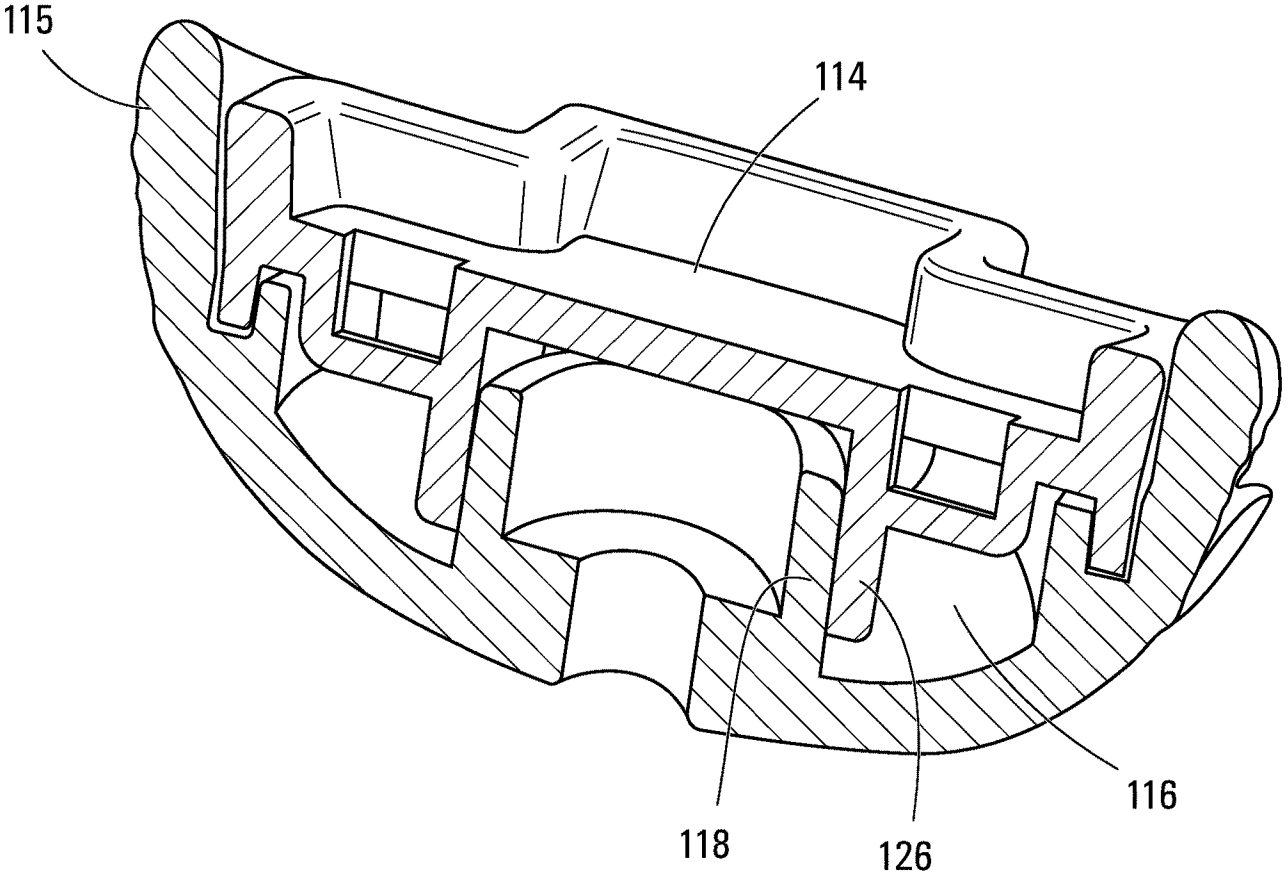
FIG. 8 is a sectional perspective view of the head shown in FIG. 7.

As can be seen in FIG. 8, the hair holder 114 and the body 112 may have hair holder post 126 and a body mounting post 118 respectively. The body mounting post 118 may be snugly received in an aperture at the end of the hair holder post 126.

Figure 9:
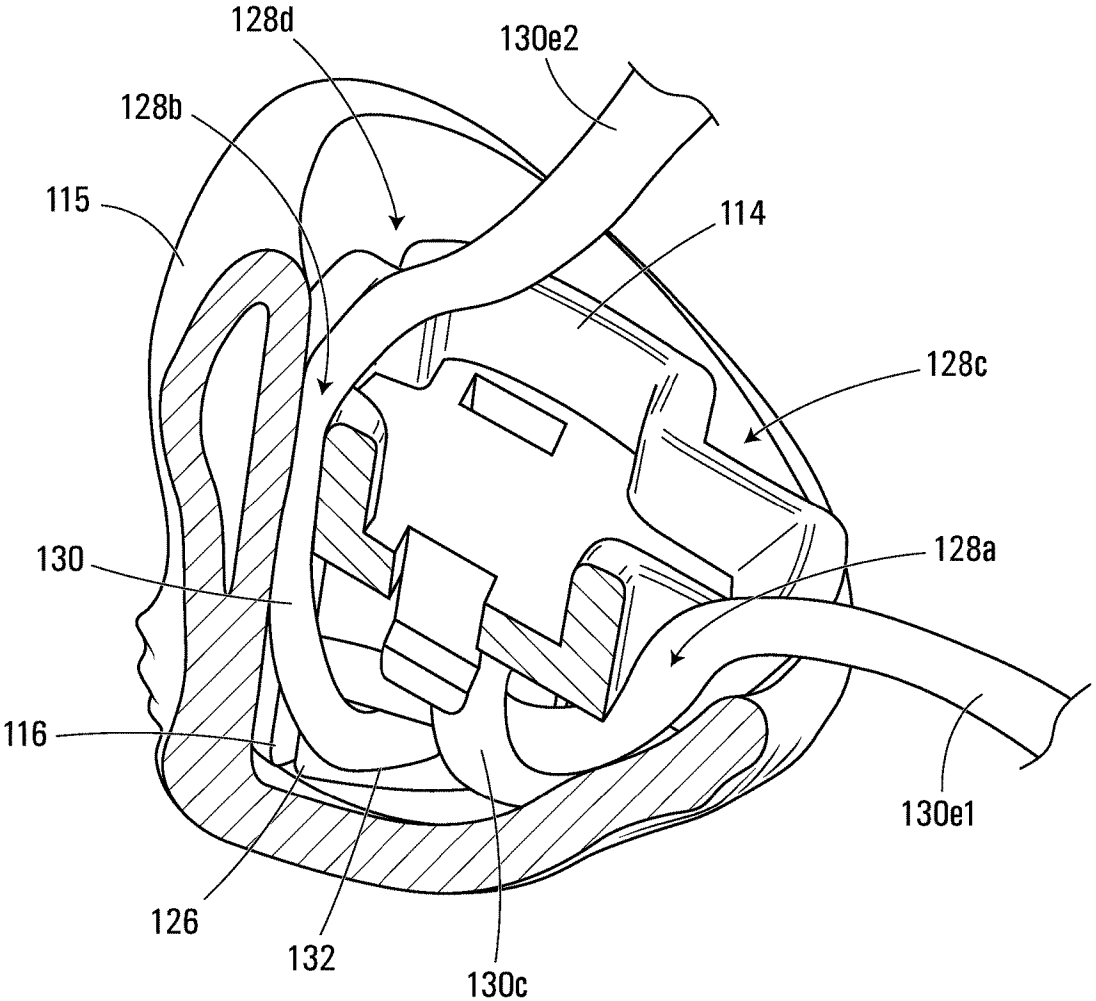
FIG. 9 is another sectional perspective view of the head shown in FIG. 7 taken in an orthogonal plane to that shown in FIG. 8.

Referring to FIG. 9 a clump of hair 130 is provided, and is similar to the clump of hair 30, and has a central region 130*c* that has a knot 132 and at least a first end portion 130*e*1 and a second end portion 130*e*2. The knot 132 is similar to the knot 32. In the example shown the central region 130*c* is tied to the hair holder post 126 via the knot 132 and so the knot 132 (and the central region 130*c*) are unable to pass through the hair pass-through apertures 128. Alternatively or additionally, the knot 132 could be made too large to pass through the hair pass-through apertures 128. The view shown in FIG. 9 may be in a plane that is orthogonal to the plan shown in FIG. 8. The section plane of FIG. 9 may be a coronal or frontal plane, for example, while the section plane of FIG. 8 may be a sagittal plane.

Figure 11:
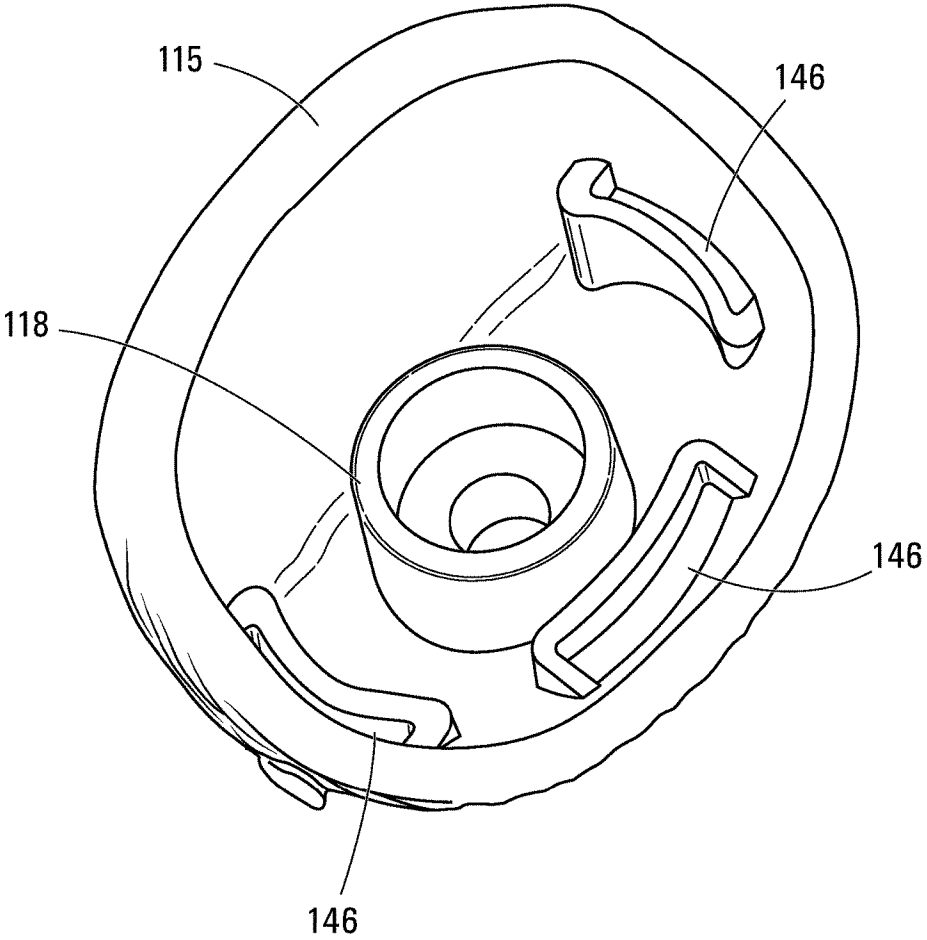
FIG. 11 is a perspective view of the head shown in FIG. 7 without the hair holder.

FIG. 10 shows the underside of the hair holder 114 and FIG. 11 shows the interior of the head 115 without the hair holder 114 mounted therein. As can be seen, the hair holder 114 may include a plurality of projections 144 at its periphery that are received in projection-receiving apertures 146 in the head 115. This improves the robustness of the connection between the hair holder 114 and the head 115. Optionally a suitable adhesive may be used to hold the projections 144 in the apertures 146 to further strengthen the connection. A suitable adhesive may also be used to join the hair holder post 126 with the body mounting post 118.

In other respects, the character FIG. 100 may be similar to the character FIG. 10.

A method of attaching hair to a body of a character figure may be as follows. The character figure (e.g. character FIG. 10, 100) has a body (e.g. body 12, 112), and a hair holder (e.g. hair holder 14, 114) that is mountable to the body and encloses an interior volume (e.g. interior volume 16, 116) therewith. The hair holder at least in part defines a plurality of hair pass-through apertures including at least a first hair pass-through aperture (e.g. hair pass-through aperture 28*a*, 128*a*) and a second hair pass-though aperture (e.g. hair pass-through aperture 28*b*, 128*b*). The method includes:

a) providing the hair as a clump of hair having a central region with a knot therein, and having a first end portion extending from the central region and a second end portion extending from the central region, wherein the knot is unable to pass through the first and second hair pass-through apertures; and b) mounting the hair holder to the body such that the knot is held in the interior volume and such that the first end portion of the clump of hair passes through the first hair pass-through aperture to an exterior of the character figure and such that the second end portion of the clump of hair passes through the second hair pass-through aperture to an exterior of the character figure.

In relation to the character FIG. 10, step b) further includes sliding the first end portion 30*e*1 from the first, open, end 38 of the first hair slot 36*a* to the enlarged region 42 of the first hair slot 36 and sliding the second end portion 30*e*2 from the first, open, end 38 of the second hair slot 36*b* to the enlarged region 42 of the second hair slot 36*b*, prior to mounting the hair holder 14 to the body 12.

Optionally, step b) further includes mounting the hair holder to the body such that a third end portion (e.g. as shown in FIG. 5A) passes through a third hair pass-through aperture to the exterior of the character figure.

Optionally, in relation to the character FIG. 10, it may be possible to remove the clump of hair from the body of the character figure. For example, the hair holder 14 may be removably mountable to the body 12, so as to permit a user to remove the hair holder 14 and to remove the clump of hair 30 from the hair holder 14 by pulling the first end portion 30*e*1 out through the first, open, end 38 of the first hair slot 36*a* and by pulling the second end portion 30*e*2 out through the first, open, end 38 of the second hair slot 36*b*, and if needed, removing the central region 30*c* from the hair holder post 26.

The hair holder 114 may also be made removably mountable to the body 112 of the character FIG. 100 so as to permit the clump of hair 30 to be removed from the body 112.

While it has been disclosed for the second end portion 30*e*2, 130*e*2 of the clump of hair 30, 130 to pass through the first hair pass-through aperture or the second hair pass-through aperture to the exterior of the character figure, it will be noted that embodiments may be provided in which the second end portion 30*e*2, 130*e*2 of the clump of hair 30, 130 remains in the interior volume 16, 116.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A character figure, comprising:

a body;

a hair holder mounted to the body and enclosing an interior volume therewith, wherein the hair holder at least in part defines a plurality of hair pass-through apertures including at least a first hair pass-through aperture and a second hair pass-though aperture; and a clump of hair having a central region with a knot, wherein the knot is positioned in the interior volume, wherein the clump of hair further includes a first end portion extending from the central region and a second end portion extending from the central region, wherein the first end portion passes through the first hair pass-through aperture to an exterior of the character figure, wherein the second end portion passes through the second hair pass-through aperture to the exterior of the character figure, and wherein the knot is unable to pass-through any of the hair pass-through apertures that hair from the clump of hair passes through, wherein the hair holder has a peripheral edge and a plurality of hair slots, each of the plurality of hair slots having a first open end at the peripheral edge and a second closed end, wherein the hair slot has an enlarged region that has an enlarged region width that is larger than a width of a portion of the hair slot immediately adjacent to the enlarged region, towards the first open end, wherein the enlarged region of a first hair slot from the plurality of hair slots is the first hair pass-through aperture, and wherein the enlarged region of a second hair slot from the plurality of hair slots is the second hair pass-through aperture.

2. The character figure as claimed in claim 1, wherein the hair holder is removably mounted to the body, so as to permit a user to remove the hair holder and to remove the clump of hair from the hair holder by pulling the first end portion out through the first, open, end of the first hair slot and by pulling the second end portion out through the first, open, end of the second hair slot.

3. The character figure as claimed in claim 1, wherein the knot itself is too large to pass through the first and second hair pass-through apertures, thereby preventing the hair clump from being removed from the body when the hair holder is mounted to the body.

4. The character figure as claimed in claim 1, wherein the body includes a head, and wherein the hair holder is mounted to the head to enclose the interior volume.

5. The character figure as claimed in claim 1, wherein the plurality of hair pass-through apertures further includes a third hair pass-through aperture and wherein the clump of hair includes a third end portion extending from the central region, wherein the third end portion passes through the third hair pass-through aperture to the exterior of the character figure.

6. A character figure, comprising:

a body;

a hair holder mounted to the body and enclosing an interior volume therewith, wherein the hair holder at least in part defines a plurality of hair pass-through apertures including at least a first hair pass-through aperture and a second hair pass-though aperture; and a clump of hair having a central region with a knot, wherein the knot is positioned in the interior volume, wherein the clump of hair further includes a first end portion extending from the central region and a second end portion extending from the central region, wherein the first end portion passes through the first hair pass-through aperture to an exterior of the character figure, wherein the second end portion passes through the second hair pass-through aperture to the exterior of the character figure, and wherein the knot is unable to pass-through any of the hair pass-through apertures that hair from the clump of hair passes through, wherein a post extends from at least one of the body and the hair holder into the interior volume, wherein the clump of hair is tied to the post via the knot thereby preventing the hair clump from being removed from the body when the hair holder is mounted to the body.

7. The character figure as claimed in claim 6, wherein the post extends from the hair holder into the interior volume.

8. The character figure as claimed in claim 6, wherein the knot itself is too large to pass through the first and second hair pass-through apertures, thereby preventing the hair clump from being removed from the body when the hair holder is mounted to the body.

9. The character figure as claimed in claim 6, wherein the body includes a head, and wherein the hair holder is mounted to the head to enclose the interior volume.

10. The character figure as claimed in claim 6, wherein the plurality of hair pass-through apertures further includes a third hair pass-through aperture and wherein the clump of hair includes a third end portion extending from the central region, wherein the third end portion passes through the third hair pass-through aperture to the exterior of the character figure.

11. A character figure, comprising:

a body;

a hair holder mounted to the body and enclosing an interior volume therewith, wherein the hair holder at least in part defines a plurality of hair pass-through apertures including at least a first hair pass-through aperture and a second hair pass-though aperture; and a clump of hair having a central region with a knot, wherein the knot is positioned in the interior volume, wherein the clump of hair further includes a first end portion extending from the central region and a second end portion extending from the central region, wherein the first end portion passes through the first hair pass-through aperture to an exterior of the character figure, wherein the second end portion passes through the second hair pass-through aperture to the exterior of the character figure, and wherein the knot is unable to pass-through any of the hair pass-through apertures that hair from the clump of hair passes through, wherein the hair holder and the body together cooperate to compress the central region of the clump of hair in the interior volume so as to inhibit the central region from moving during manipulation of any of the end portions of the clump of hair.

12. The character figure as claimed in claim 11, wherein the knot itself is too large to pass through the first and second hair pass-through apertures, thereby preventing the hair clump from being removed from the body when the hair holder is mounted to the body.

13. The character figure as claimed in claim 11, wherein the body includes a head, and wherein the hair holder is mounted to the head to enclose the interior volume.

14. The character figure as claimed in claim 11, wherein the plurality of hair pass-through apertures further includes a third hair pass-through aperture and wherein the clump of hair includes a third end portion extending from the central region, wherein the third end portion passes through the third hair pass-through aperture to the exterior of the character figure.

* * * * *